US005839935A

United States Patent [19]

Han et al.

[11] Patent Number: 5,839,935

[45] Date of Patent: Nov. 24, 1998

[54] METHOD FOR MAKING SHADOW MASK FOR COLOR PICTURE TUBE

[75] Inventors: DongHee Han, Suwon; Hwanchul Rho, Kyungki-do; Jaemyung Kim, Suwon, all of Rep. of Korea

[73] Assignee: Samsung Display Devices Co., Ltd., Suwon, Rep. of Korea

[21] Appl. No.: 686,148

[22] Filed: Jul. 24, 1996

[30] Foreign Application Priority Data

Nov. 8, 1995 [KR] Rep. of Korea ..... 1995-40314

[51] Int. Cl.[6] ..... H01J 29/07

[52] U.S. Cl. ..... 445/47

[58] Field of Search ..... 228/37, 47

[56] References Cited

U.S. PATENT DOCUMENTS

| | | | |
|---|---|---|---|
| 4,442,376 | 4/1984 | Van Der Waal et al. | 445/47 |
| 4,629,932 | 12/1986 | Tokita | 445/47 X |
| 5,752,755 | 5/1998 | Rho et al. | 445/47 X |

FOREIGN PATENT DOCUMENTS

| | | |
|---|---|---|
| 139379 | 5/1985 | European Pat. Off. . |
| 851589 | 10/1985 | Rep. of Korea . |

*Primary Examiner*—Kenneth J. Ramsey
*Attorney, Agent, or Firm*—Christie, Parker & Hale, LLP

[57] ABSTRACT

Disclosed is a method for making a shadow mask for a color picture tube. First, a flat AK steel plate is pressed to form an AK steel shadow mask. And then, the AK steel shadow mask is surrounded with minute metal particles and is heated in a neutral or reduction heating furnace, thereby forming an alloy layer on a surface of the AK steel shadow mask.

8 Claims, 4 Drawing Sheets

METHOD FOR MAKING SHADOW MASK FOR COLOR PICTURE TUBE

BACKGROUND

The present invention relates generally to a method for making a shadow mask for a color picture tube and, more particularly, to a method for forming an anti-doming material on the shadow mask.

A color picture tube of a shadow mask type has electron beams emitted from an electron gun which pass through apertures of the shadow mask to land on R, G and B pixels, respectively, on a phosphor layer.

However, part of the electron beams pass through the apertures of the shadow mask and the rest strike the inner face of the shadow mask to heat it. As a result, the shadow mask is thermally expanded and domes out, such that the position of the apertures is changed against the electron beam. Thus, a demand for compensating the change is proposed.

Referring to FIG. 5, there is illustrated a conventional shadow mask 1 which is secured to a frame 3 which is mounted at a panel by a spring 5.

On the inner surface of the panel 7, there is deposited a phosphor layer containing phosphor pixels that respectively emit red R, green G and blue B light. The shadow mask 1 is spaced in a predetermined distance from the phosphor layer.

In addition, the shadow mask 1 is generally made of pure iron, for example aluminum killed (AK) steel. This AK steel has a thermal expansion coefficient of about $11.7\times10^{-6}$/K.

When the tube operates, electron beams emitted from an electron gun pass through corresponding apertures of the shadow mask 1 and correctly land on the aimed phosphor pixels to display a picture.

However, about 80% of the electron beams strike the inner surface of the shadow mask to thereby increase the temperature of the shadow mask to about 80–90° C.

As a result, the shadow mask 1 is thermally expanded and domes out as shown in a broken line of FIG. 5 such that the paths of the electron beams which pass through the shadow mask are shifted from the phosphor pixels to thereby deteriorate the white uniformity. That is, the path of the electron beam is displaced from a position B1 to a position B2 and thereby the corresponding phosphor pixel is also displaced from a position P1 to a position P2.

To solve the above described problems, shadow masks made of invar alloy having an extremely low thermal expansion coefficient are well known.

However, invar alloy is difficult to form and the cost thereof is high, leading to increased manufacturing costs.

Therefore, the Korean Patent No. 85-1589 discloses a method for forming an electron radiation layer on the shadow mask to solve the doming problem. The European Patent No. 139,379 discloses a method for forming a low expansion layer on the shadow mask.

However, since all the methods described above are technically complicated, it is difficult to apply the methods to actual production.

SUMMARY

It is an object of the present invention to provide a method for fabricating a shadow mask for a color picture tube with a much simpler fabrication process while providing low thermal expansion, and high electron reflecting and thermal radiation effects.

The above and additional objects are realized in accordance with the present invention which provides a method for making a shadow mask for a color picture tube, comprising the steps of:

pressing a flat AK steel shadow mask to form an AK steel shadow mask;

surrounding the AK steel shadow mask with minute metal particles; and heating the AK steel shadow mask surrounded with the minute metal particles in a neutral or reduction heating furnace to thereby form an alloy layer on a surface of the AK steel shadow mask.

Preferably, the minute metal particles comprise one or more materials selected from the group consisting of tungsten(W), bismuth(Bi), zirconium(Zr), and boron(B).

Preferably, the temperature of the neutral or reduction heat furnace is set at about 850–1,200° C.

Also preferably, the size of the minute metal particles is in a range from about 0.1 to about 2.5 $\mu$m.

According to another feature of the present invention, a method for making a shadow mask for a color picture tube, comprises the steps of:

pressing a flat AK steel plate to form an AK steel shadow mask;

subjecting the AK steel shadow mask in a neutral or reduction heating furnace; and spraying minute metal particles into the heating furnace to thereby form an alloy layer on a surface of the AK steel shadow mask.

BRIEF DESCRIPTION OF THE DRAWINGS

The foregoing and other objects of the present invention will become apparent from the detailed description below when taken in conjunction with the following drawings in which.

DESCRIPTION

While the invention will be described and illustrated in connection with certain preferred embodiments and examples, it should be understood that it is not intended to limit the invention to those particular embodiments and examples. To the contrary, it is intended to cover all alternatives, modifications and equivalents falling within the spirit and scope of the invention as defined by the appended claims.

Reference will now be made in detail to the present invention, examples of which are illustrated in the accompanying drawings. Wherever possible, the same reference numbers will be used throughout the drawings to refer to the same or like parts.

Figure 1:
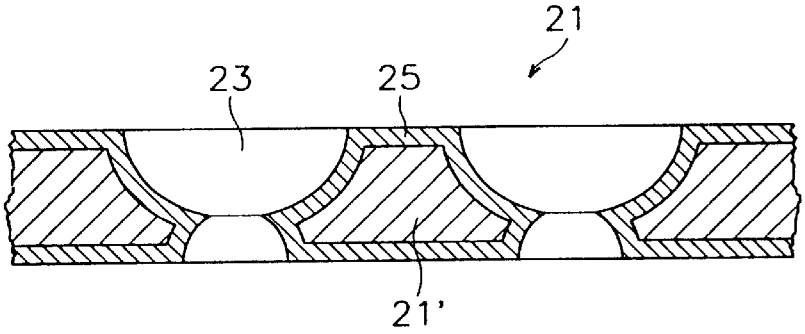
FIG. 1 is a partially cut away sectional view for showing a shadow mask made by methods in accordance with embodiments of the present invention.

Referring first to FIG. 1, there is partially illustrated a shadow mask 21 made by methods according to embodiments of the present invention.

The shadow mask 21 comprises an AK steel shadow mask 21' having a thermal expansion coefficient of about $11.7\times10^{-6}$/K and provided with a plurality of apertures 23 through which electron beams pass. The AK steel shadow mask 21' is coated on its whole surface with an alloy layer 25 having a predetermined thickness, preferably more than 10 $\mu$m.

The alloy layer 25 is formed by cementating the AK steel shadow mask 21' in minute metal particles including one or more materials selected from the group consisting of tungsten(W), bismuth(Bi), zirconium(Zr), and boron (B). This will be described more in detail hereinafter.

Figure 2:
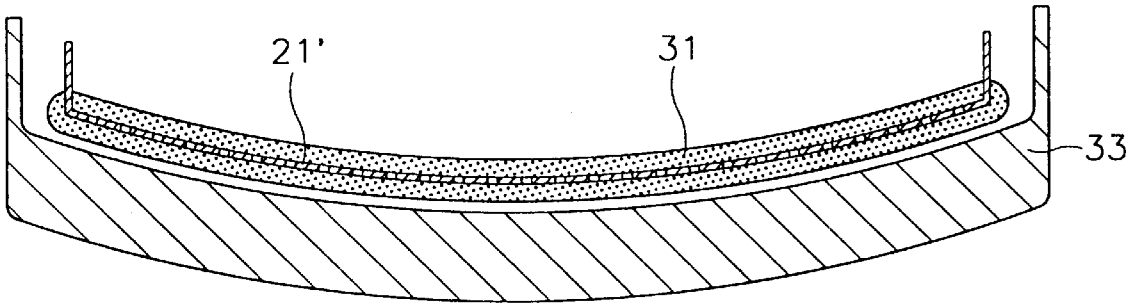
FIG. 2 is a view illustrating a method for making a shadow mask according to an embodiment of the present invention.

Referring now to the method for making the above shadow mask 21 according to a first embodiment of the present invention in conjunction with FIG. 2, the AK steel shadow mask 21' is pressed to form a bead and a skirt portion such that the bead and skirt portions are formed on the AK steel shadow mask 21'.

Next, the AK steel shadow mask 21' is disposed in a mould 33 having a curvature corresponding to that of the AK steel shadow mask and containing minute metal particles 31 by which the AK steel shadow mask 21' is surrounded.

The minute metal particles 31, as described above, comprises one or more materials selected from the group consisting of tungsten(W), bismuth(Bi), zirconium(Zr), and boron (B) . Each metal particle has a size of about 0.1–2.5 $\mu$m.

The size of the metal particles affects on the thickness of the alloy layer 25. Thus, if the metal particle has a size bigger than 2.5 $\mu$m, since the cementation speed is reduced, the heating temperature and time should be increased. If the size of the metal particle is less than 0.1 $\mu$m, the cost for manufacturing the metal particles is increased and cohesion between the metal particles may occur.

Thereafter, the mould 33 storing the AK steel shadow mask 21' surrounded by the metal particles 31 is thrown into a neutral or reduction heat furnace to be cementated such that the alloy layer 25 is formed on the surface of the AK steel shadow mask 21'.

At this point, the temperature of the neutral or reduction heat furnace is set at about 850–1,200° C. in consideration that the temperature of transformation point of the AK steel is approximately 800° C. However, the temperature of the heating furnace may be set at a relatively higher temperature in accordance with the kind of the metal particles.

The alloy layer 25 comprises alloy steel selected from the group consisting of Fe-W, Fe-WC, Fe-B, and Fe-Bi. The alloy layer 25 consisting of Fe-W or Fe-WC generally has a thermal expansion coefficient of about $4.5–11.7\times10^{-6}$/K which can suppress the doming of the shadow mask. The alloy layer consisting of Fe-B or Fe-Zr which is amorphous alloy has been found to be lower than the invar in its thermal expansion coefficient. Accordingly, the AK steel shadow mask 21' covered with this amorphous alloy has an outstanding effect to reduce the thermal expansion thereof.

In addition, since each of the materials W and Bi has a relatively high electron-reflecting efficiency of about 0.45–0.50, the alloy layer 25 formed by Fe-W, Fe-WC, or Fe-Bi reduces the extinction amount of the electron beams incident to the shadow mask to thereby suppress doming of the shadow mask 21.

Further, each of the alloys, Fe-W, Fe-WC, and Fe-Bi, has a relatively high thermal radiation efficiency of about 0.8–0.9. This also helps to suppress doming of the shadow mask.

Figure 3:
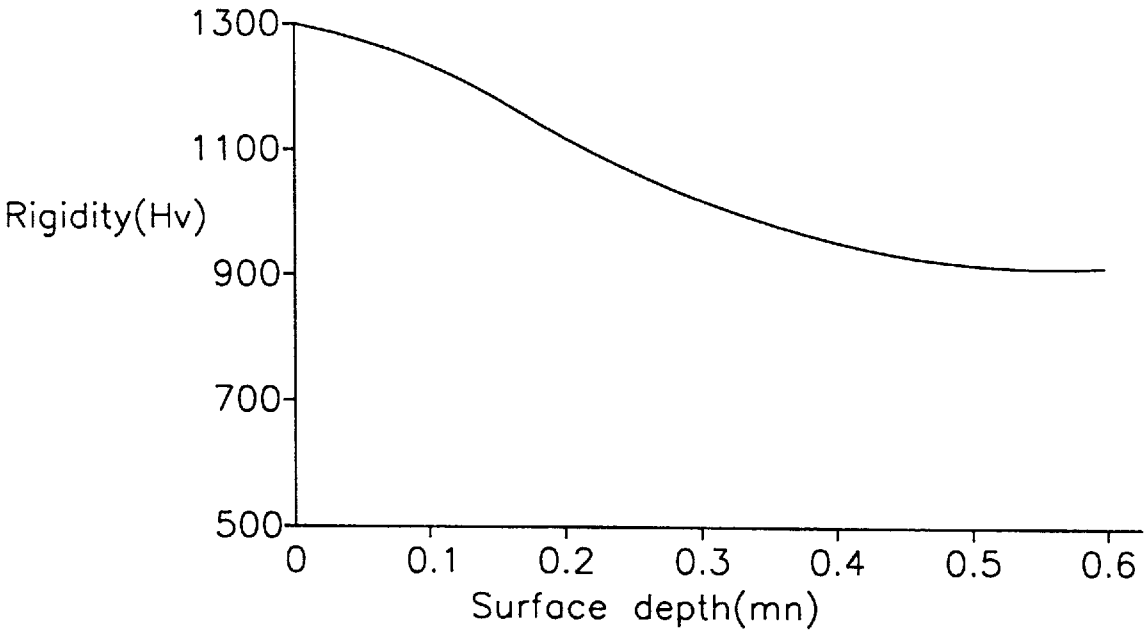
FIG. 3 is a view illustrating a method for making a shadow mask according to another embodiment of the present invention.

FIG. 3 shows the relationship between the rigidity and the surface depth of the Fe-Wc alloy layer formed by applying minute particles of WC.

Figure 4:
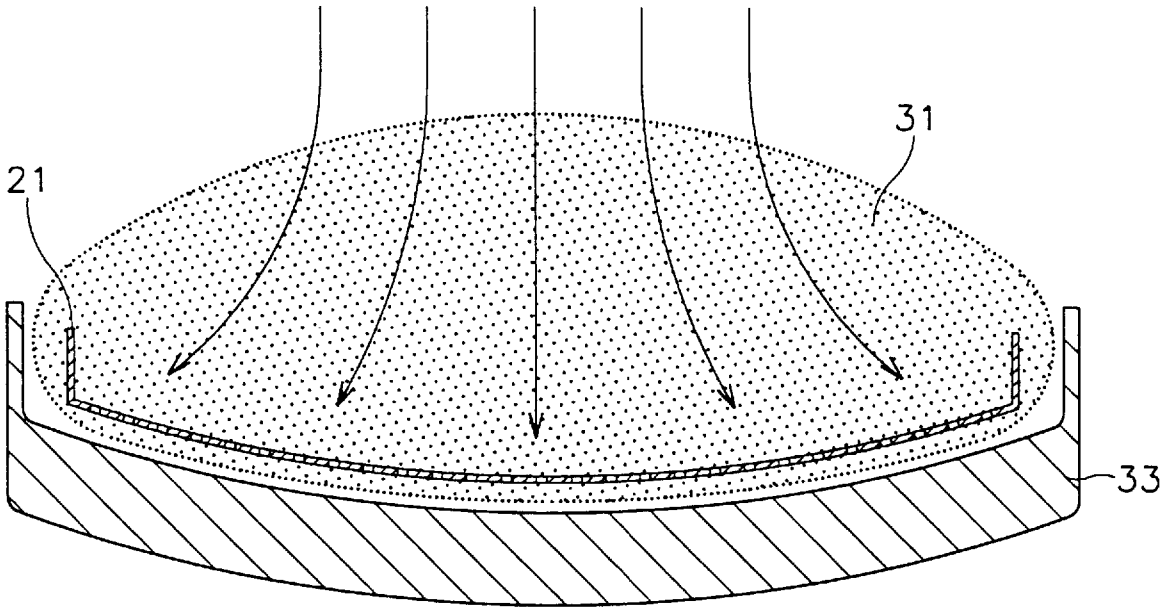
FIG. 4 is a partially sectional view for showing a shadow mask made by a method in accordance with a third embodiment of the present invention.
Figures 5A, 5B:
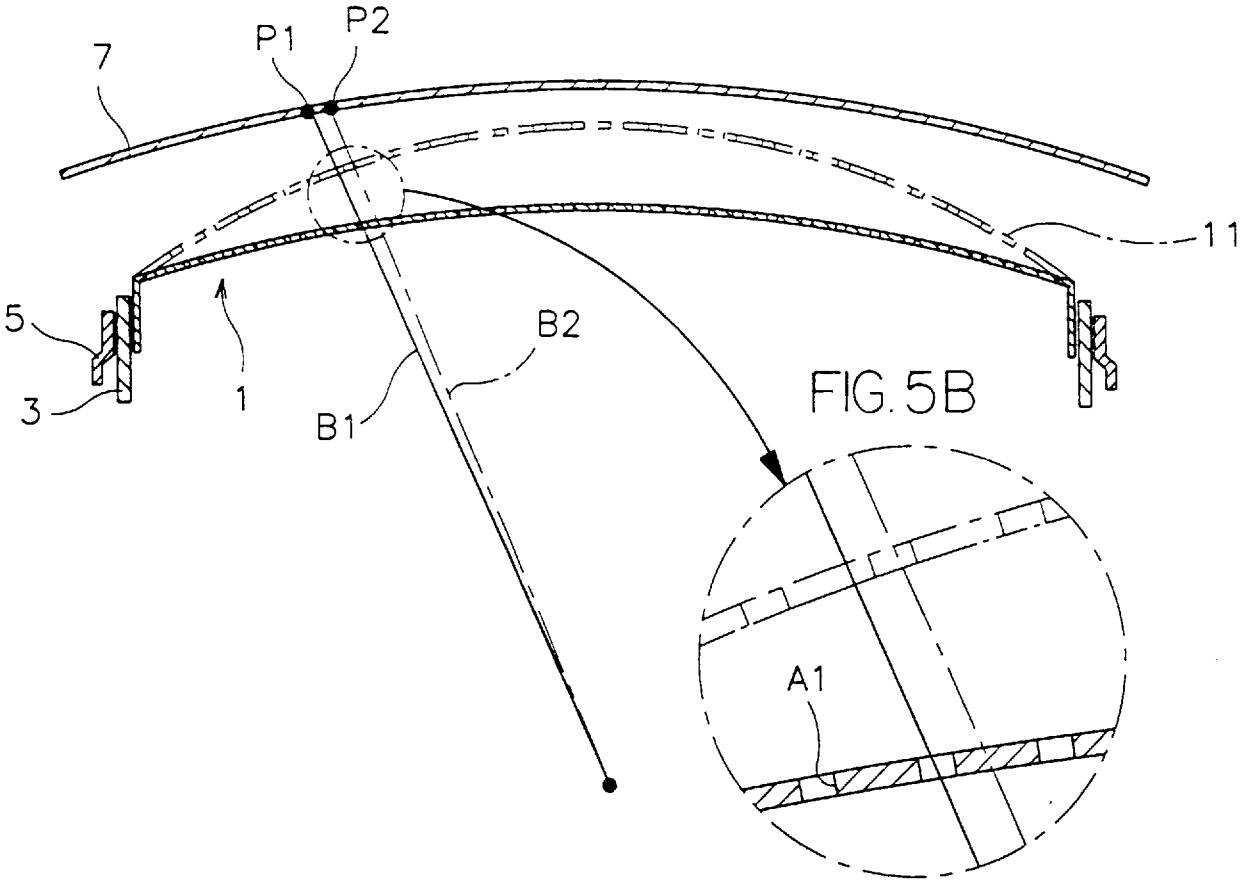
FIG. 5 is a sectional view showing a conventional color picture tube.

FIG. 4 shows a second embodiment of the method for making the shadow mask 21.

In this embodiment, a flat AK steel shadow mask is first pressed to obtain the AK steel shadow mask 21' having a bead and a skirt portion.

Next, the AK steel shadow mask 21' is disposed in a mould 33 having a curvature corresponding to that of the AK steel shadow mask and is transferred to a heat furnace.

At this state, minute metal particles are sprayed into the heat furnace with nitrogen gas to cementate the AK steel shadow mask 21' , thereby forming an alloy layer on the surface of the AK steel shadow mask 21'.

In this embodiment, the minute metal particles 31 comprise also one or more materials selected from the group consisting of tungsten(W), tungsten carbide(WC), bismuth (Bi), zirconium(Zr), and boron(B). The size of the metal particles and the thermal treatment condition are the same as those of the first embodiment.

The second embodiment has an advantage that a cleaning process for eliminating the metal particles after the cementation process is not required.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for making a shadow mask for a color picture tube, comprising the steps of:

pressing a flat AK steel plate to form an AK steel shadow mask;

surrounding the AK steel shadow mask with minute metal particles; and heating the AK steel shadow mask surrounded with the minute metal particles in a neutral or reduction heating furnace, thereby forming an alloy layer on a surface of the AK steel shadow mask.

2. The method for making a shadow mask according to claim 1, wherein the minute metal particles comprises one or more materials selected from the group consisting of tungsten(W), bismuth(Bi), zirconium(Zr), and boron(B).

3. The method for making a shadow mask according to claim 1, wherein the temperature of the neutral or reduction heat furnace is set at about 850–1,200° C.

4. The method for making a shadow mask according to claim 1, wherein the size of the minute metal particles is in a range from about 0.1 to about 2.5 $\mu$m.

5. A method for making a shadow mask for a color picture tube, comprising the steps of:

pressing a flat AK steel plate to form an AK steel shadow mask;

transferring the AK steel shadow mask in a neutral or reduction heating furnace; and spraying minute metal particles into the heating furnace to thereby form an alloy layer on a surface of the AK steel shadow mask.

6. The method for making a shadow mask according to claim 5, wherein the minute metal particles comprise one or more materials selected from the group consisting of tungsten(W), bismuth(Bi), zirconium(zr), and boron(B).

7. The method for making a shadow mask according to claim 5, wherein the temperature of the neutral or reduction heat furnace is set at about 850–1,200° C.

8. The method for making a shadow mask according to claim 5, wherein the size of the minute metal particles is in a range from about 0.1 to about 2.5 $\mu$m.

* * * * *